US005321968A

United States Patent [19]

Poole et al.

[11] Patent Number: 5,321,968

[45] Date of Patent: Jun. 21, 1994

[54] ONE PIECE TUBING CONNECTOR AND METHOD OF FORMING SAME

[76] Inventors: Henry T. Poole, 103 Rosewood Ln., Brandon, Miss. 39042; James O. Crout, 330 Crosspark Dr., Apt. 8, Brandon, Miss. 39208; Larry A. Joy, 216 Fannin Landing Cir., Brandon, Miss. 39042

[21] Appl. No.: 908,222

[22] Filed: Jul. 2, 1992

[51] Int. Cl.[5] ..... B21K 21/12

[52] U.S. Cl. ..... 72/306; 72/356; 72/318

[58] Field of Search ..... 72/306, 355.4, 356, 72/318, 367, 370; 29/890.14

[56] References Cited

U.S. PATENT DOCUMENTS

| | | | |
|---|---|---|---|
| 1,868,094 | 7/1932 | Devine | 72/306 |
| 3,648,509 | 3/1972 | McDowell | 72/318 |
| 4,192,167 | 3/1980 | Huebner et al. | 72/356 |

FOREIGN PATENT DOCUMENTS

| | | | |
|---|---|---|---|
| 137701 | 6/1950 | Australia | 72/355.4 |

*Primary Examiner*—Lowell A. Larson
*Attorney, Agent, or Firm*—Alexander F. Norcross

[57] ABSTRACT

An integral, one piece tubular product with a threaded end for mating with threaded connectors is produced by preforming a series of compression and expansion operations on the end of a tubing blank to provide a sufficiently thick wall structure for the formation of rolled threads, and to directly form an external hex head surface for the application of wrenching forces.

6 Claims, 5 Drawing Sheets

104
6c
104
104

6c
110
90
100
96
16
80
30
106
86
1
102
104
2
4

6b 6b
66
64
50
16
30
68
2
4

6a 6a
52
50
16
30
46
54
2
4

6

6
32
36
38
2
30
35
34
16
4

ONE PIECE TUBING CONNECTOR AND METHOD OF FORMING SAME

BACKGROUND OF THE INVENTION

This patent relates to the field of tubing and tubing connectors. Metal tubing is widely used for the supply of liquids and gases under high pressures and temperatures. Sections of such tubing are connected by fittings which must fasten together straight sections of tubing, by providing a joint which withstands mechanical separation forces and which does not leak.

The such joints are typically formed by mounting separate threaded connectors to the tubing ends. These separate connectors are slid over the tubing section ends and permit the tubing ends to be fastened together by interlocking corresponding connectors. Such connections are referred to herein as two piece connectors. Securing the connectors to the tubing ends forms the basis of the mechanical interconnection. In the prior art, such connections are usually formed by either flaring the tube so that the connector bears on the tube, applying sufficient force to hold the tubing ends in tight connection, or a relatively soft metal collar is deformed by the connector against the outer wall of the tubing to form both a seal against leaks and a means for the connector to grip the tube to exert forces against the tendency of the tubing joint to come apart.

SUMMARY OF THE INVENTION

An integral, one piece tubular product with a threaded end for mating with threaded connectors is produced by preforming a series of compression and expansion operations on the end of a tubing blank to provide a sufficiently thick wall structure for the formation of rolled threads, and to directly form an external hex head surface for the application of wrenching forces, The forming operation is a four step process:

A tubing blank (a section of tubing) is clamped in a stationary position with an end section exposed for forming: the end section of the tube is compressed in length, increasing wall thickness in the end section.

This tube end is then expanded diametrically and at the same time compressed at the lower end of the thick wall section to provide additional material at that location.

The tube is then compressed in length to increase wall thickness, sufficiently that, when the tube end is expanded the resulting wall remains sufficiently thick to thread.

The tube is then expanded diametrically, within a punch cavity, simultaneously forming a bead which fills a hex shaped cavity, thereby forming both an external hex surface and an O-ring sealing surface.

The thickened tube end is then threaded by having threads rolled on the thickened end of the tubing blank.

As a result of these process steps, a sufficiently thick and strong section of material is formed in a series of quick punching operations on the end of a standard tubing blank. The process produces a unique one piece tubing end connector out of tube stock. The resulting product is significantly improved over the prior art joining methods in terms of resistance to mechanical failure and leakage resistance.

The product also has advantages over the prior art two piece connection in terms of product cost, equipment and labor needed to install two piece connectors and the mechanical properties of the tubing end region due to the cold working.

It is thus an object to the invention to disclose a process for forming a threaded connection on a standard tubing stock which forms a suitable threaded connector directly on the tubing end.

It is a further object of the invention to disclose a unitary, one piece tubing connection for joining to threaded tubing connectors.

It is a further object of the invention to disclose a tubing end connector which has significantly reduced susceptibility to mechanical failure and leakage in comparison with two piece or field assembled threaded tubing connectors.

It is a further object of the invention to disclose a tubing end connector for mating with threaded connectors which is produced at lower cost and with greater ease of manufacturing.

These and other objects of the invention will be seen from the detailed description of the invention below.

DETAILED DESCRIPTION OF THE INVENTION

Figures 1A, 1B, 2A, 2B, 3A, 3B, 4A, 4B:
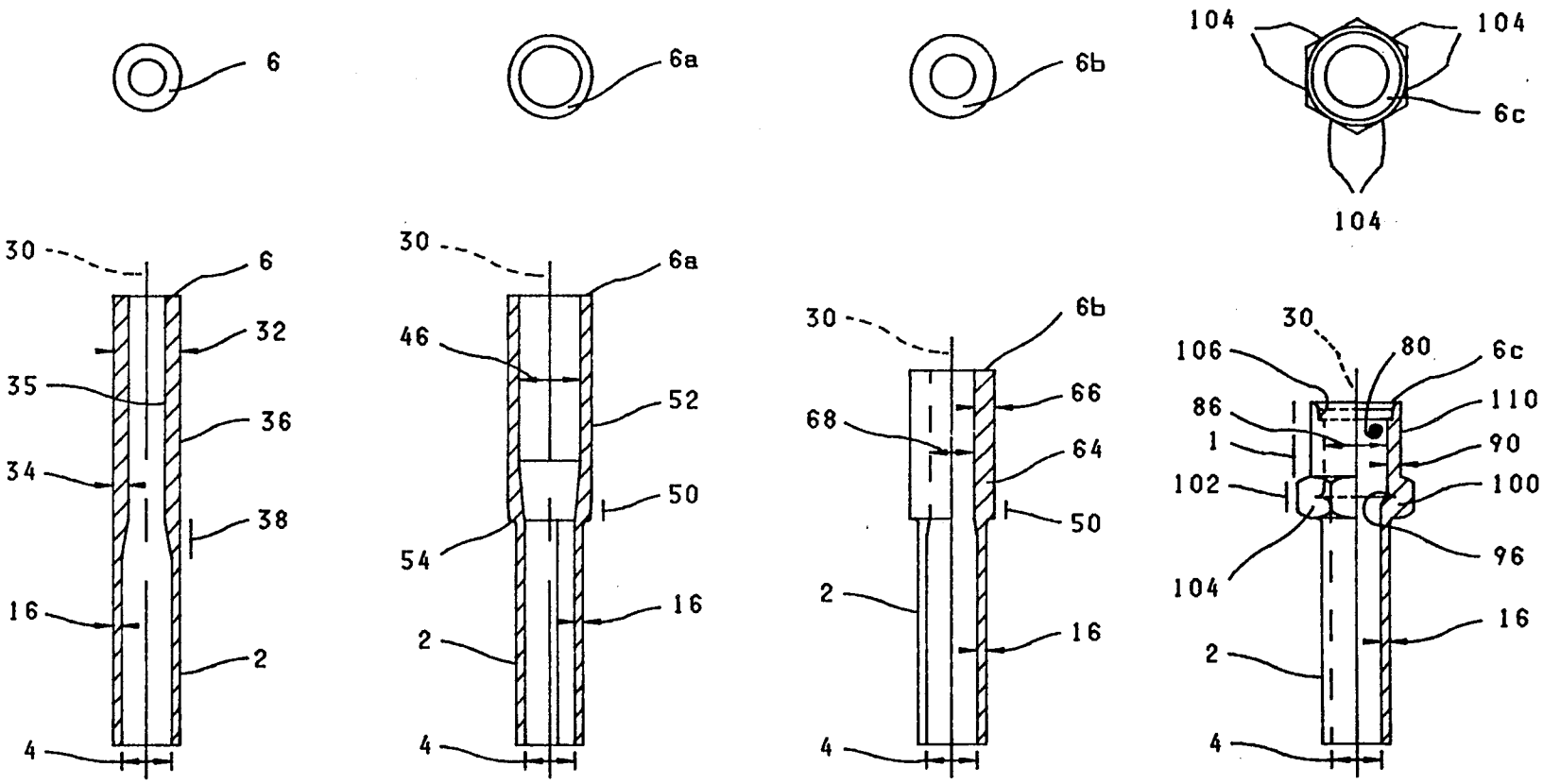
FIG. 1 is a view of a tubing end after the first step of the formation process.
FIG. 2 is a view of a tubing end after the second step of the formation process.
FIG. 3 is a view of a tubing end after the third step of the formation process.
FIG. 4 is a view of a tubing end after the forth step of the formation process.
Figure 5:
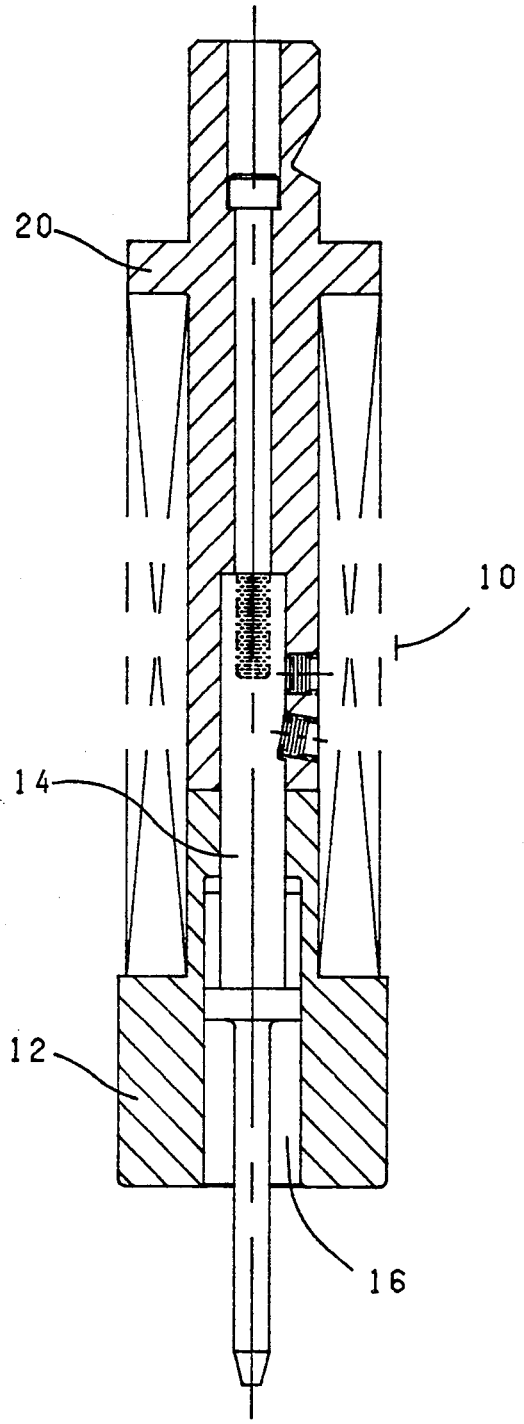
FIG. 5 is a view of the first punch for forming the tubing end in the first step of the inventive process.
Figure 6:
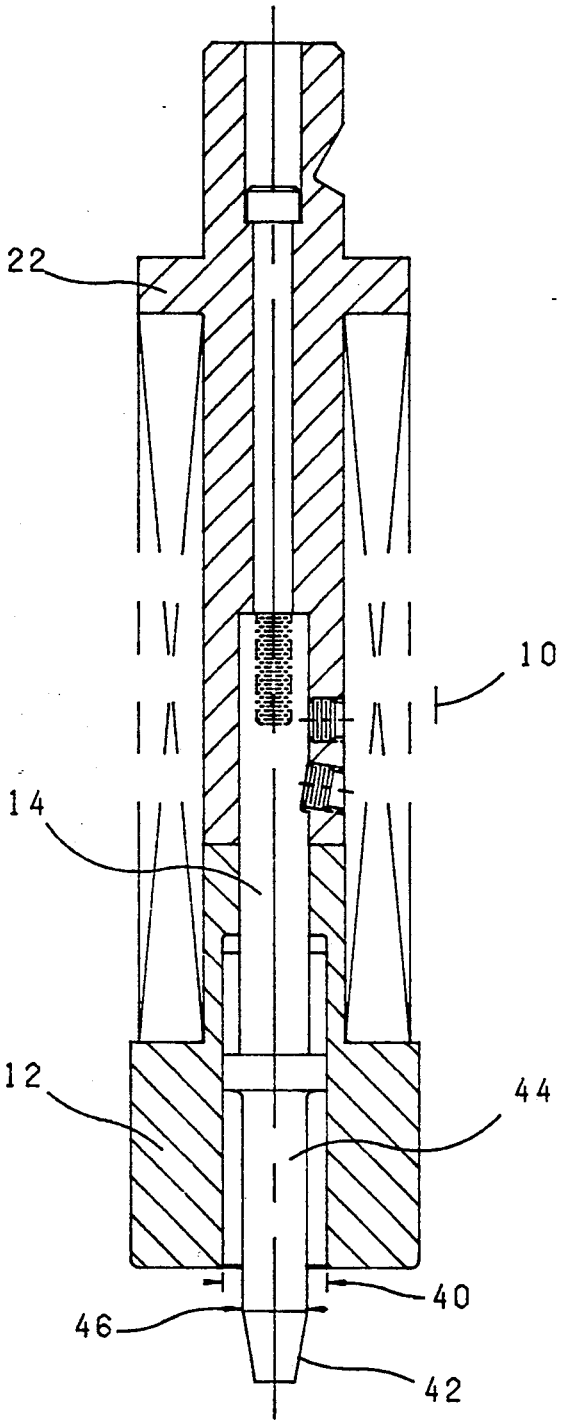
FIG. 6 is a view of the second punch for forming the tubing end in the second step of the inventive process.
Figure 7:
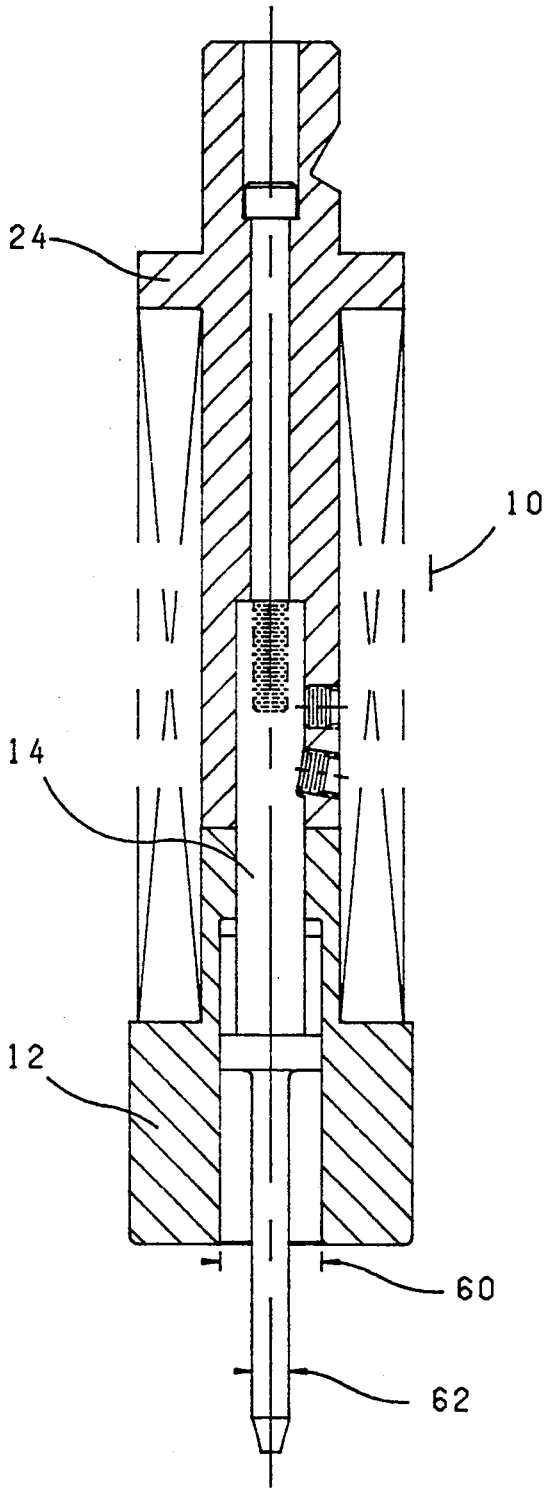
FIG. 7 is a view of the third punch for forming the tubing end in the third step of the inventive process.
Figure 8:
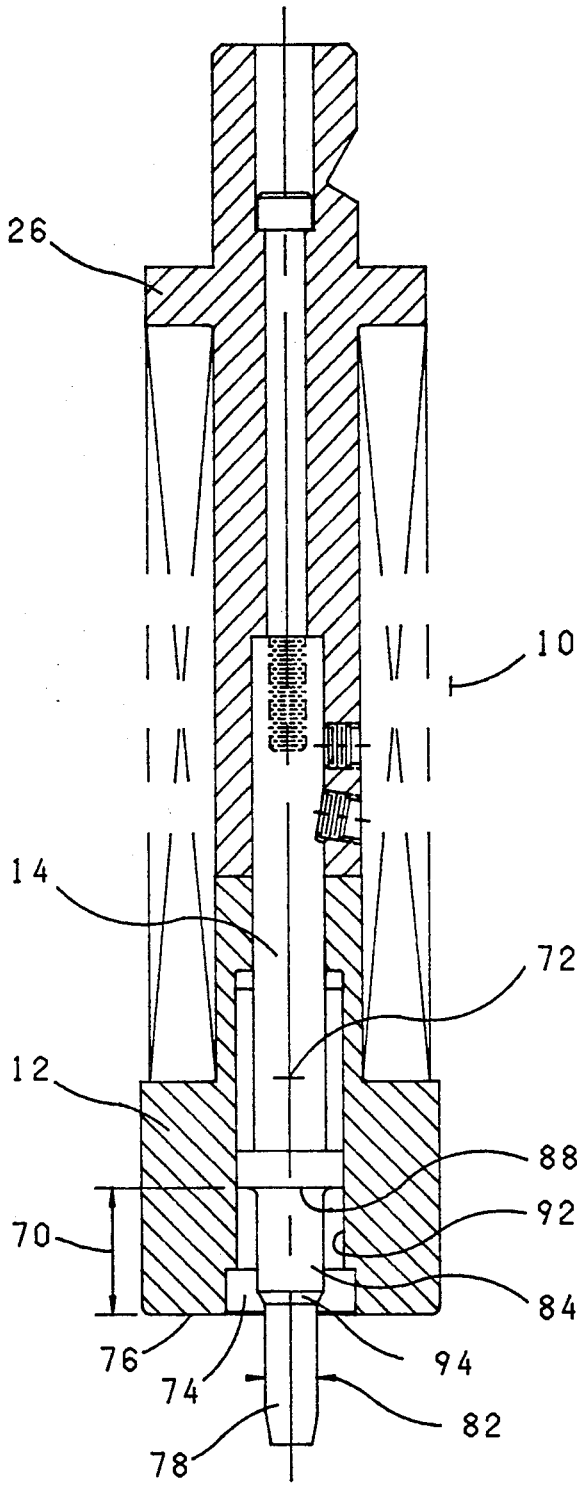
FIG. 8 is a view of the fourth punch for forming the tubing end in the fourth step of the inventive process.

The formation of the inventive connector 1, as shown in the drawings, is performed using a series of formation steps with tubing end punches designed to function within an otherwise standard tube end forming machine. In the preferred embodiment, the inventive connector is formed with a Manchester Hydraulic tube end forming machine as manufactured by the Manchester Tool and Die, Inc, of North Manchester Ind.

The functioning of this machine is well understood in the field of tubing manufacturers. The machine functions by gripping and holding a tube blank 2, an unformed section of tubing stock, in a compressive jaw (not shown) which holds the tube blank stationary against axial forces, but does not crush the tube or significantly reduce its inside diameter. 4

The forming machine holds the tubing blank 4 in a horizontal position, and then extends a punch to form the tube end 6. The machine then retracts the punch, and indexes a punch holder to align a next punch with the tube blank. This next punch is then extended to further form the tube end. The machine repeats the cycle until the tube formation is completed. Such prior art operations include forming recesses for O-rings, forming flares for installation of connectors and forming beads or external rings on the tube.

While the embodiment of the process here described uses the described machine, it will be apparent to those skilled in the tubing products manufacturing art how other equivalent machines may be used for the process described, and the process is not restricted to the forming machine described.

Likewise the process for making the initial tubing blank, and mounting it in the machine, supporting it so that the formation steps may be performed on the end of the blank without collapsing the blank, and moving and staging the punches through each of the processing steps to create a completed product, are all well known in the art, and will not be explicated herein.

Tubing stock which has been formed by the processes of the prior art remains a thin walled material, unsuitable for threading, as the material thickness is insufficient to provide the necessary strength to be directly threaded or connected, other than by in-situ processed such as welding.

In the inventive process, a one piece threadable end 1 is formed on the end 6 of a tubing blank 2 by a sequence of steps each involving the axial driving of a punch 10 onto the exposed end 6 of a tubing blank 2. Each of the described punches 10 is constructed to match the compressive jaws used to hold the tubing blank, and each is in the form of an external or outer sleeve 12 within which is centered an interior punch extension 14. This outer sleeve 12 and the interior punch extension 14 together form an internal annular cavity 16, within which the tubing end 6 is formed. The outer sleeve 12 is generally in the form of a cylindrical hollow sleeve, and the interior punch extension 14 is a cylindrical shaft, axially centered within the punch sleeve 12, which is be shaped so as to control the internal diameter of the tubing end during forming.

The inventive process comprises successive axial compressions of the tube end 6, while restraining the tube internal surface 35 against the punch extension 14 and the tube outer surface 36 against the punch sleeve 12, so that the tube wall of an upper section of the tube blank 2 is successively thickened and expanded. Successive compressive steps are used to form a smooth transition region 38 in wall thickness, ultimately forming a region of excess material 50 in this transition region 38. When sufficient material has been build up both in wall thickness and in the transition region 50, an axial compression of the tube deforms the excess material 50 in the transition region into a cavity to form an external wrenching surface below a smooth thick walled cylindrical end 6c which will support threading. An attempt to form the end in single step would result in excessive metal deformation in the transition region, resulting in material weakness, possible tearing or crack failures, and leaving insufficient material for formation of external wrenching surfaces. Other formation steps require multiple machines or dies, and result in excess steps and labor above the prior art assembly of connector ends out of separate parts.

In a preferred embodiment of the process, a tubing blank 2, a tube section of uniform wall thickness 16 and internal diameter 4, is mounted and supported for compressive forming. A first hydraulically powered punch 20 is driven along the longitudinal axis 30 of the tubing blank 2. This first punch 20 supports the exterior surface 36 of the tubing blank, maintaining a constant external diameter 32 so as to prevent extrusion or folding of the blank 2, and simultaneously applies an axial compressive force onto the end 6 of the tubing blank 2. As a result the tubing blank end 6 is compressed axially, increasing the wall thickness 34 of an end section 6. It should be noted that this forming operation has the result of decreasing the internal diameter 4 of the tubing blank in the end section 6, as the outer wall 36 of the tubing blank was supported during the forming operation. It should also be noted that this increased wall thickness 34 is uniform for a distance along the end 6 of the tubing blank, ending in a transition region 38 of tapered wall thickness blending into the remainder of the tubing blank 4 which remains at its original wall thickness 16. No abrupt change in wall thickness, which might create structural weakness, occurs.

In the second step, the thickened tubing blank end 6a is expanded with a second punch 22 which has an expanded outer diameter sleeve 40, and a tapered entry 42 lower inner punch section 44 so that the inner diameter 46 of the upper end section 6a of the tubing is expanded to be slightly greater than the inner diameter 4 of the unformed tubing blank 2. The taper 42 at the bottom of inner punch section 44 is located so as to insert into the tapered transition region 38 of the blank from the first step, necking down the inner diameter 46 of the upper end 6a of the tube to smoothly meet the inner diameter 4 of the unformed tubing blank 2, and forming thereby a region of excess material 50. An expanded outer wall 52 is formed on the end of the tubing blank, creating an an external neck ridge 54.

In the third step a third punch, with a sleeve 12 defining an expanded outer diameter 60 and a punch extension defining an inner diameter 62 which is slightly less than the inner diameter 4 of the unformed tubing blank, axially compresses the formed end 6a of the tubing blank, forming a further thickened wall section 64. The thickness 66 of this third step wall section 64 is made greater than that required, so that, when the end 6b is expanded in the fourth step, the resulting expanded end 6c will remain sufficiently thick walled to accept the formation of rolled or cut external threads.

For the final, fourth step, the tubing end 6b has been prepared, and now consists of a thick wall end 64. The inner diameter 68 of this prepared end 6b is less than the inner diameter 4 of the unformed tubing blank.

The fourth punch 26 is formed with a shortened inner space 70, an expanded, tapered, two section inner punch extension 72, and a Hex shaped cavity 74 at the lower end of the punch 26. The lower section 78 of the inner punch extension 72 begins the expansion of the interior 80 of the tubing end 6c; the expansion diameter 82 of this lower section 72 is greater than the inner diameter 4 of the unformed tubing blank. As the punch is further driven onto the tubing, the upper section 84 of the inner punch 72 then expands the end 6c of the tubing to an inner diameter 86 somewhat greater than the inner diameter of the unformed tubing blank. The reduced height 70 of the interior of the punch 26 further compresses the tubing end 6c axially downward.

The upper section 84 of the inner punch 72 compresses the tubing end 6c wall section axially shorter. Inner Punch Upper Section 84 sets the wall thickness 90 of the tubing end 6c against the exterior retaining face 92 of the punch 26, by controlled expansion of the tube end 6c. A transition neck 94 in the inner punch 72 between the lower section 78 and upper section 84 aids in creating an outer flow 96 of the tubing wall 100 at the section 102 where the inner diameter 86 of the tubing end 6c reduces to the inner diameter 4 of the unformed tubing blank 4. At this point of outer flow 96 the tubing wall 100 flows and deforms into the hex cavity 74 in the fourth punch 26, forming an external hex face 104 for a wrenching surface. A groove 106 in the upper end 6c of the tube for mounting a sealing O-ring may also be formed in this fourth step by providing a suitable bump on the inner punch of the fourth punch 26.

The changes of tube end inner diameter 86 at the transition point 102, and the region of excess material 50 in the tubing blank as formed in the second and third steps, provides sufficient material so that even though there is a perceptible internal fold 96 at the hex face 104 after formation, the connection end 1 thus formed on the tubing blank 2 is full strength, and is not susceptible to mechanical failure.

Threads may then be formed in a separate process, such as by rolling, on the prepared connection end on the tubing blank. The technique for this is well known, and not discussed further here. It is clear that the inventive forming steps have created a connector blank 1, on the end of a standard tubing blank 2, which, unlike thin wall tubing, is substantially strong, has a wrenching face 104 for the application of necessary wrenching and joining forces, and has sufficient material thickness 90 to permit the formation of strong threads on its external surface 110.

In regards to the wrenching face 104, a hex face is shown, hex wrenches being the most common for assembly of tubing assemblies in the field; however any suitable exterior face shape, for the application of assembly torque forces to the tubing connector, may be formed by means of this invention. Likewise, the thickness 90 of the end wall formed by the inventive steps permits any threads to be formed, whether by rolling or by cutting, without loss of strength in the end connector 1.

When so threaded, the tubing end is fully the equal of a two piece threaded connection, but is a monolithic structure, free from sources for leaks, and structurally stronger than any prior art multi-part compressive or flared fitting. Further, as the connector is formed of the same material as the tubing, the chances of galvanic corrosion failure due to dissimilar metal fittings being installed has been eliminated.

It can thus be seen that the resulting one piece tubing connector is unique, and the process for its manufacture is novel. The invention extends beyond the exact embodiment disclosed to its equivalents as inherent in the claims. In particular, it is clear that variations in the formation steps are possible within the scope of the invention, for the formation of the thickened walls, the shortening of the walls for additional material strength, and the expansion of the thickened tubing blank to form both a threadable end surface and a suitable external wrenching face.

I claim:

1. A method for forming a unitary connector on the end of a tubing blank comprising the sequential cold working steps without heating of the tubing blank of:

grasping the blank in an external compressive law to hold the blank stationary without crushing the blank and then in sequence without intervening steps:

first, compressing an end section of said tubing blank axially while restraining the outer diameter of said end section to the same outer diameter as the tubing blank, thereby increasing wall thickness of said end section with respect to said tubing blank, forming a smooth transition in wall thickness from the formed section to the tubing blank;

second, expanding said end section diametrically, tapering the thickness of a lower section of said end section to form a material pocket of excess material;

third, compressing said end section while restraining the outer diameter of said end section to further increase said end section wall thickness; and fourth, compressing said end section, expanding the material pocket of excess material into a cavity shaped to form a hex shaped exterior face on said lower section.

2. The method of claim 1 further comprising:

forming a spiral thread on the exterior of said end section down to said hex shaped exterior face.

3. The method of claim 1 the first step further comprising:

providing a first punch having an interior punch extension spaced within an outer retaining sleeve, forming an interior punch cavity;

said outer retaining sleeve having a diameter equal to the diameter of said tubing blank;

said interior punch extension having a face for exerting an axial compressive force on the end of said end section;

driving said first punch axially onto said end section.

4. The method of claim 1 the second step further comprising:

providing a second punch having an interior punch extension spaced within an outer retaining sleeve, forming an interior punch cavity;

said outer sleeve having an inner diameter greater than the diameter of said tubing blank;

said interior punch extension having a tapered entry and a straight section having a diameter greater than the inner diameter of said tubing blank;

driving said second punch axially onto said tubing end section, whereby said tapered entry forms said material pocket.

5. The method of claim 1 the third step further comprising:

providing a third punch having an interior punch extension spaced within an outer retaining sleeve, forming an interior punch cavity;

said outer retaining sleeve having a inner diameter equal to the outer diameter of the tubing end section produced by said second step;

said interior punch extension having an elongate, straight shaft having a diameter less than the inner diameter of said tubing blank;

driving said third punch axially onto the tubing end section produced by said second step, compressing said end section, forming a thick walled cylindrical shape.

6. The method of claim 1, the fourth step further comprising:

providing a fourth punch having an interior punch extension spaced within an outer retaining sleeve, forming an interior punch cavity;

said outer retaining sleeve having an upper straight wall section having an inner diameter substantially equal to the diameter of a standard threaded coupler sized for said tubing blank, and a lower section forming a hex form cavity;

said interior punch extension having a tapered end, a lower straight section having a diameter equal to the inner diameter of said tubing blank, a tapered expansion above said lower section; an upper straight section having a diameter greater than said inner diameter of said tubing blank;

said tapered expansion being aligned with said hex form cavity;

driving said fourth punch axially onto the tubing end section produced by said third step;

said tapered expansion cooperating with said hex form cavity, expanding said end section, extruding said material pocket into said hex form cavity, thereby forming a hex shaped exterior face on said lower section.

* * * * *